United States Patent [19]

Kuper et al.

[11] 4,139,328

[45] Feb. 13, 1979

[54] METHOD OF OPERATING LARGE TURBO COMPRESSORS

[75] Inventors: Klaus D. Kuper, Hamminkeln-Mehrhoog; Rolf Albers, Bottrop; Hans-Peter Hillebrand, Essen-Kettwig; Wolfgang Hofmeister; Kurt Ewe, both of Karlsruhe; Luigi Tuis, Bochum, all of Fed. Rep. of Germany

[73] Assignees: Gutehoffnungshitte Sterkrade AG, Oberhauser; Siemens AG, Berlin, both of Fed. Rep. of Germany

[21] Appl. No.: 800,302

[22] Filed: May 25, 1977

[51] Int. Cl.[2] ..... F04D 27/00

[52] U.S. Cl. ..... 415/1; 415/27

[58] Field of Search ..... 415/1, 27, 28; 60/39.29

[56] References Cited

U.S. PATENT DOCUMENTS

| | | | |
|---|---|---|---|
| 2,478,423 | 8/1949 | Ponomareff et al. | 415/27 |
| 3,276,674 | 10/1966 | Hens | 415/1 |
| 3,292,845 | 12/1966 | Hens et al. | 415/1 |
| 3,424,370 | 1/1969 | Law | 415/27 |
| 3,473,727 | 10/1969 | Eastman | 415/27 |
| 4,046,490 | 9/1977 | Rutshtein et al. | 415/27 |

FOREIGN PATENT DOCUMENTS

| | | | |
|---|---|---|---|
| 2046629 | 1/1972 | Fed. Rep. of Germany | 415/27 |

*Primary Examiner*—C. J. Husar

*Attorney, Agent, or Firm*—Cushman, Darby & Cushman

[57] ABSTRACT

A method of operating turbo compressors. To prevent pumping surges, blow-off valves are opened upon reaching a blow-off line extending parallel, with respect to time, to the pumping limit. The difference between the compressor discharge pressure and flow rate and the blow-off line is non-linearly amplified in a manner related to the actual pressure and flow rate so that the amplification gain is increased if the operating point of the compressor shifts into the non-permissible range beyond the blow-off line. Special provisions are made for starting the compressor.

6 Claims, 6 Drawing Figures

METHOD OF OPERATING LARGE TURBO COMPRESSORS

The present invention relates to a method of operating large turbo compressors, particularly of furnace blast compressors in which the rate of flow and the discharge pressure are measured continuously and compared with permissible values, wherein, in order to avoid pumping surge, i.e. prior to reaching the surge limit or compressor pulsation limit, one or more blow-off valves are opened upon reaching a blowing-off line or curve extending parallel with the surge limit, such that the rate of flow of the compressor does not fall below a minimum value depending on the discharge pressure.

Pumping limit control processes of this type have already been performed by using mechanico-hydraulic controllers. In spite of a high expenditure of technical instruments, however, it is not possible in the conventional control systems to exactly simulate the blowing-off line so as to positively prevent pumping surges from occuring. Another drawback resides in the high expense of maintenance and in the high susceptibility to trouble of these mechanico-hydraulic control systems.

Also, it is know to employ an electronic pumping limit control; compare "Mittleilung (Notice) 542" of the Warmestelle des Vereins deutscher Eisenhuttenleute (Thermal Department of the German Metallurgical Society). The pumping limit control in compressors having variable guide vanes is of similar structure as that of compressors having variable throttles, with the exception, however, that a function generator for forming the reference or control input of the pumping limit controller is provided because of the non-linear pumping limit curve (characteristic).

In these conventional control systems, it has been found to be disadvantageous that pumping surges of the compressor cannot be prevented from occuring with the requisite positiveness under certain operational conditions, e.g. when the control system is controlled manually and under great pressure variations. While occasional pumping has heretofore been considered as tolerable, it has recently been found that even occasional pumping surges must be avoided.

Recent investigations showed that in the case of large-size blast compressors having a rated performance of the order of about 25 NW (megawatts) every pumping surge subjects the vanes to stresses of such magnitude that the elastic limit is exceeded and failure of the vanes inevitably occurs. In view of the fact that the present day furnace blast compressors for reasons of efficiency are designed in such a way that every compressor supplies a single blast furnace, great pressure variations are encountered particularly in "upsetting" or "crushing", and it is accordingly very difficult to prevent even occasional pumping surges from occuring. This applies particularly to high-duty blast furnaces the resistance or drag characteristic curve is close to the pumping limit.

Accordingly, it is the object of the present invention to provide for positive prevention of pumping surges in large turbo compressors, especially in the case of compressors controlled by guide vane adjustment and exhibiting a non-linear pumping (surge) limiting line, wherein, for reasons of the efficiency, the blowing-off curve should be as close as possible to the pumping limit line. The expense required for the control system should be as low as possible, and the control system should lend itself to be constructed of commercially available circuit elements. Also, the control system should allow to perform manual control manipulation and to initiate start-up operations.

According to the present invention, this object is solved in a method of the aforementioned type by non-linearly amplifying the control difference of the pumping limit controller for adjusting the blow-off valves and being dependent on the actual values of pressure and flow, in such a manner that the amplification (factor) or gain is increased if the control difference goes to the negative, i.e. if the operating point of the compressor shifts into the non-permissible range beyond the blowing-off line or curve.

In order to start up operation of the compressors, advantageously the controller is additionally supplied with a controlled time-dependent or timed signal the polarity of which is opposite to that of a permissible control difference.

In a further development of the invention, it is contemplated that, in order to positively prevent pumping even in extreme instances of interference, a device being independent of the remainder of the control is caused to operate for opening the blow-off valves, when the compressor operating point reaches a cut-off line or curve falling between the pumping and blowing-off limits.

Even if the blow-off valves are adjusted manually, it is advantageous to perform a selection of extreme values of the signale received ahead of the pumping limit controller, such that the difference of the manual control command and the controller output signal is subjected to a selection of the minimum value with equal status to the control difference.

Below, an exemplary embodiment ot the present invention is explained in greater detail by referring to the enclosed drawings, wherein.

Figure 1:
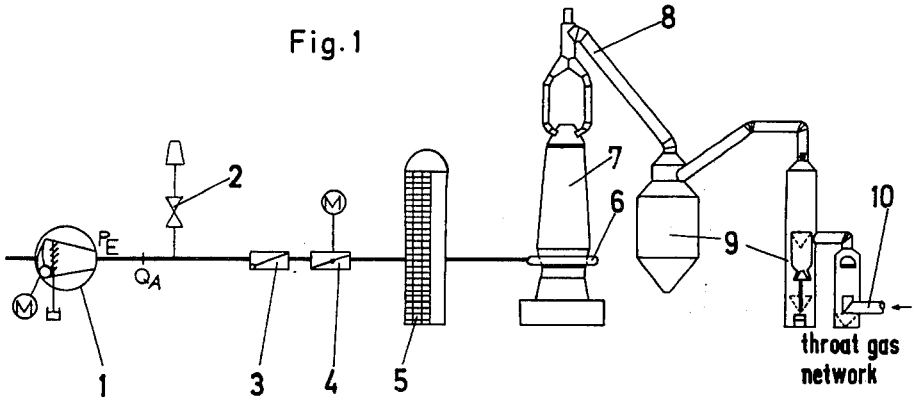
FIG. 1 shows a block diagram of a blast supply system for a blast furnace.

According to the schematical showing of FIG. 1, a furnace blast compressor 1 produces in the blast network connected thereto a given flow of blast air at a given pressure. Immediately downstream of the compressor 1, a blow-off valve 2 is provided which acts to vent a portion of the flow of blast air to the atmosphere, if necessary. Following such valve, there are provided a nonreturn valve 3 and a control valve or shut-off valve 4, downstream of which the hot-blast stoves or regenerators 5 are positioned, with only one of such regenerators being shown in the Figure in order to simplify the presentation. Thereupon, the blast air flows into the ring mains 6 to be blown from the latter into the blast furnce 7 through tuyere connections. The throat gas thereafter produced during the blast furnace process flows through throat 8 into a scrubbing system 9 and from the latter into the throat gas system 10. Presently, the blast furnace back-pressure is most frequently controlled via the scrubbing system. The pressure existing within the throat gas network is likewise controlled in another position, and the throat gas network, thus, represents a huge accumulator of constant pressure.

Figure 2:
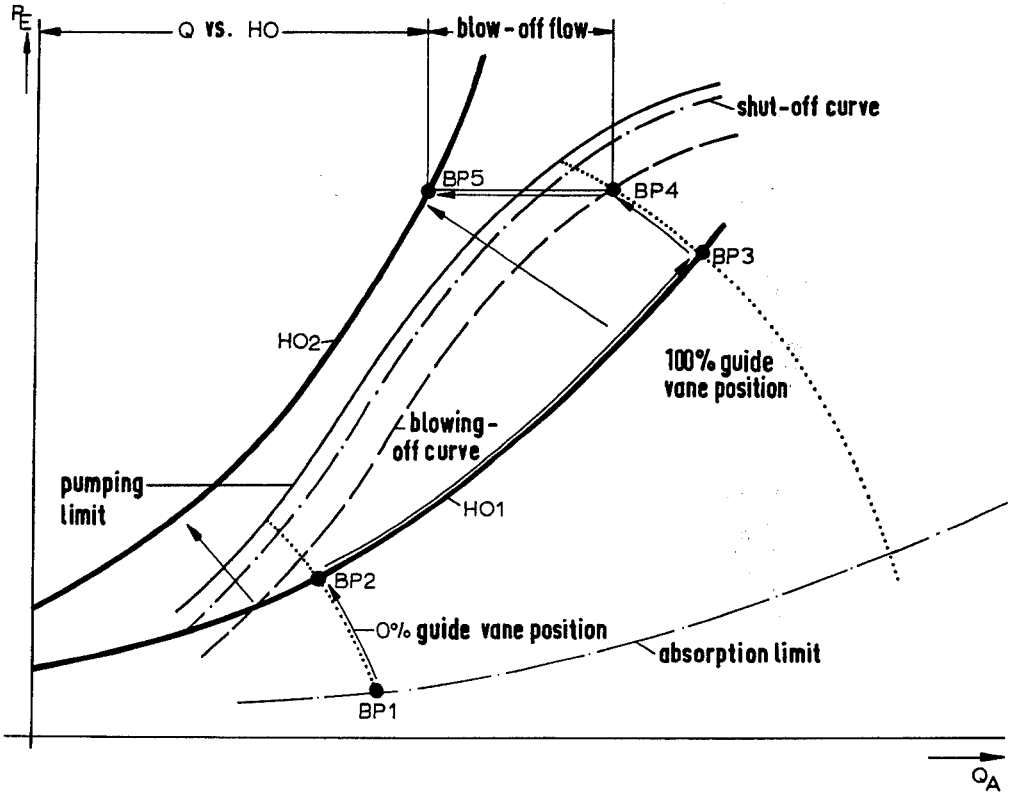
FIG. 2 shows a typical family of compressor characteristics with the blast furnace characteristic illustrated.

In FIG. 2, the characteristic curves of resistance or drag of a blast furnace are shown in the area depicting the family of characteristics of a compressor wherein the flow $Q_A$ is shown on the abscissa and the discharge pressure $P_E$ on the ordinate. In normal operation, the compressor is started up with the blow-off valves in fully open position; hereby, the operating point BP1 is obtained.

When the blow-off valves are closed subsequently, the operating point of the compressor slowly shifts along the characteristic curve showing the guide vane position parameter or the rate-of-speed parameter of 0%, respectively, up to the point of intersection BP2 with the characteristic curve of drag HO1 of the blast furnace. Now, when the guide vanes are opened still further or the rate of speed is increased, respectively, the characteristic HO1 of the compressor is displaced upwards up to its load or stress limit in the operating point BP3.

When the drag characteristic HO1 then shifts towards a higher value of drag so as to enter the drag characteristic HO2, the operating point of the compressor progresses on the guide vane characteristic 100% up to the blowing-off line or curve in the operating point BP4. At this point, the blow-off valves start to be opened such that, although the compressor maintains the pressure, the flow which is not accepted by the blast furnace, is vented to the atmosphere.

Figure 3:
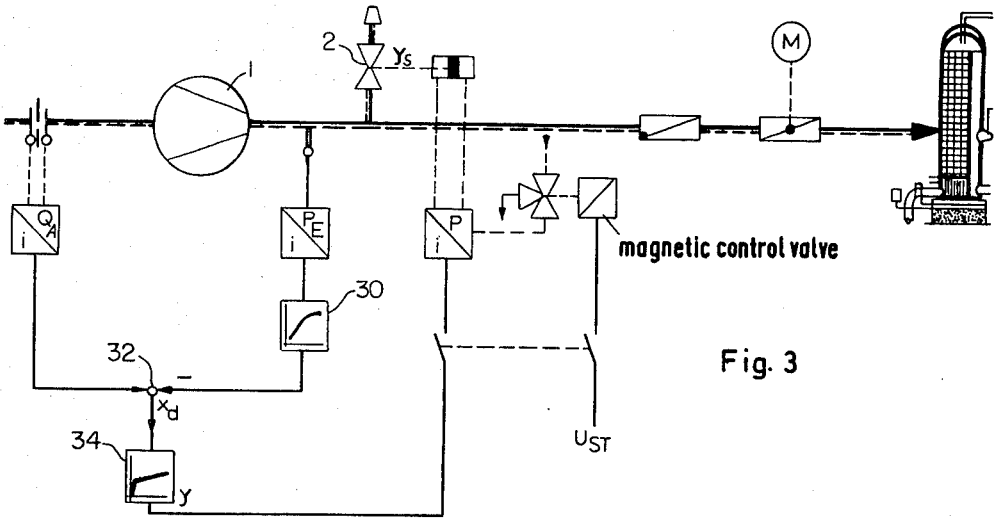
FIG. 3 shows the circuit diagram of a conventional electronic control system for a furnace blast compressor.

In order to provide for positive opening of the blow-off valves upon reaching the blowing-off curve, a conventional electrical circuit according to FIG. 3 may be employed. The measured values of compressor 1 throughflow $Q_A$ and of the discharge pressure $P_E$ are converted into electrical signal, with the signal of the discharge pressure $P_E$ being converted in correspondence with the blowing-off curve by function generator 31. The difference of the signals is formed, in customary manner, at comparison or reference point or junction 32, and this difference is applied to a PI controller 34 as the control difference, which controller, in turn, provides the (manipulated) variable y for the blow-off valves.

As mentioned above, this kind of control is not effective to prevent pumping in every instance, particularly if overshooting is encountered following great pressure variations.

Figure 4:
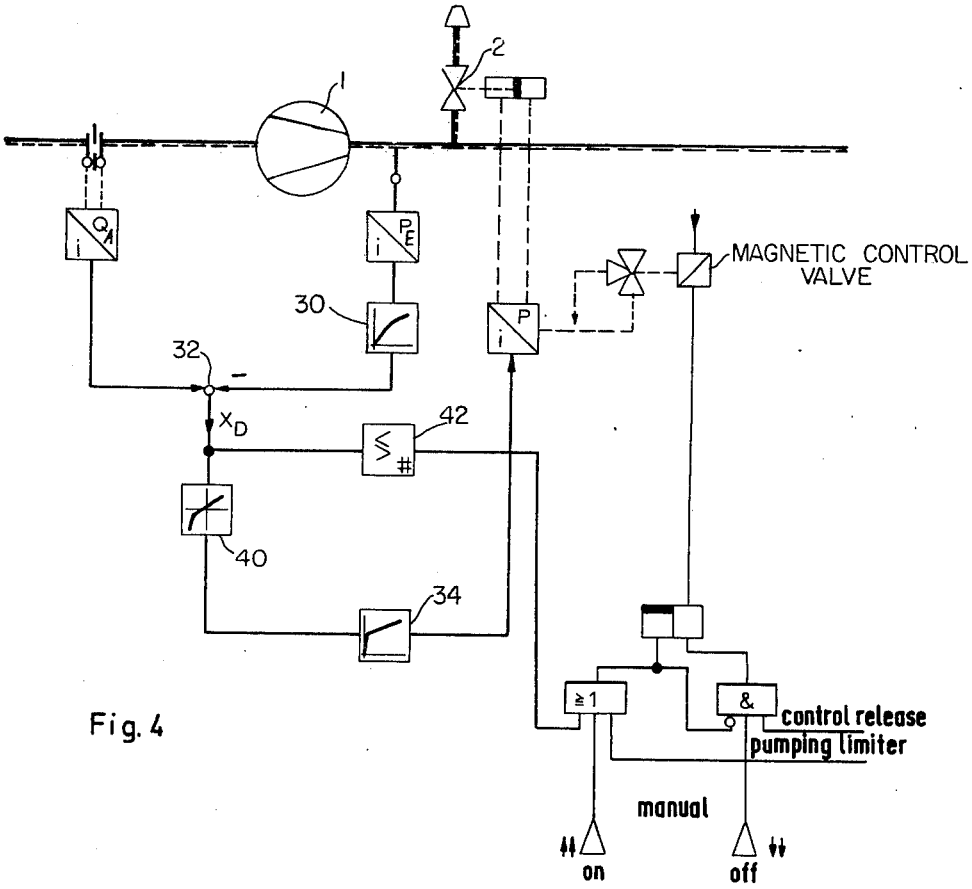
FIG. 4 shows the circuit diagram of a control system including non-linear amplification (gain)

Therefore, according to the present invention and as can be seem from FIG. 4, non-linear transmission element 40 is connected to the input side of controller 34. In the comparison or reference position for forming the control difference $x_D$, it is obtained by proper selection of the sign that permissible control differences bear a positive sign and non-permissible control differences bear a negative sign. A positive control difference of the pumping limit controller means that the operating point of the compressor is in the portion of the characteristic curves (FIG. 2) at the right hand of the blowing-off curve, whereas this point is at the left hand side of the blowing-off curve in the case of a negative control difference.

The amplifier (gain) characteristic of the non-linear transmission element 34 is hereby composed of at least two straight lines of increasing slope. The break of the characteristic curve is set so as to fall within the negative quadrant; in this way, it is obtained that small negative control differences as may be caused by noisy signals, are negated up to a predetermined magnitude. At greater, and therefore non-permissible, control differences, a higher amplification (gain), e.g. to the ratio of 1 : 5, of the control difference is effected, and this causes increasing intervention of the pumping limit controller and therefore more rapid opening of the blow-off vales such that the compressor operating point is returned into the permissible range.

Furthermore, the control difference $x_D$ formed in the reference position is compared in limit control means 42 with a limit value having a run corresponding to the cut-off curve of FIG. 2 and which, as can be seen therein, is still ahead of the pumping limit, but spaced from the blowing-off curve by such distance that this value is reached only in the case of failure of the control system of coincidence of most unfavorable conditions of control dynamics. When the limit value is exceeded, the blow-off valves are opened to full degree by a suitable independent control system.

During start-up operations, on the one hand the normal operating condition is to be reached as soon as possible, while, on the other hand, the high overshooting states which may be encountered with the use of normal PI controllers and which might result in pumping, should be eliminated as far as possible. According to the present method, therefore, the start-up operation is controlled automatically.

Figure 5:
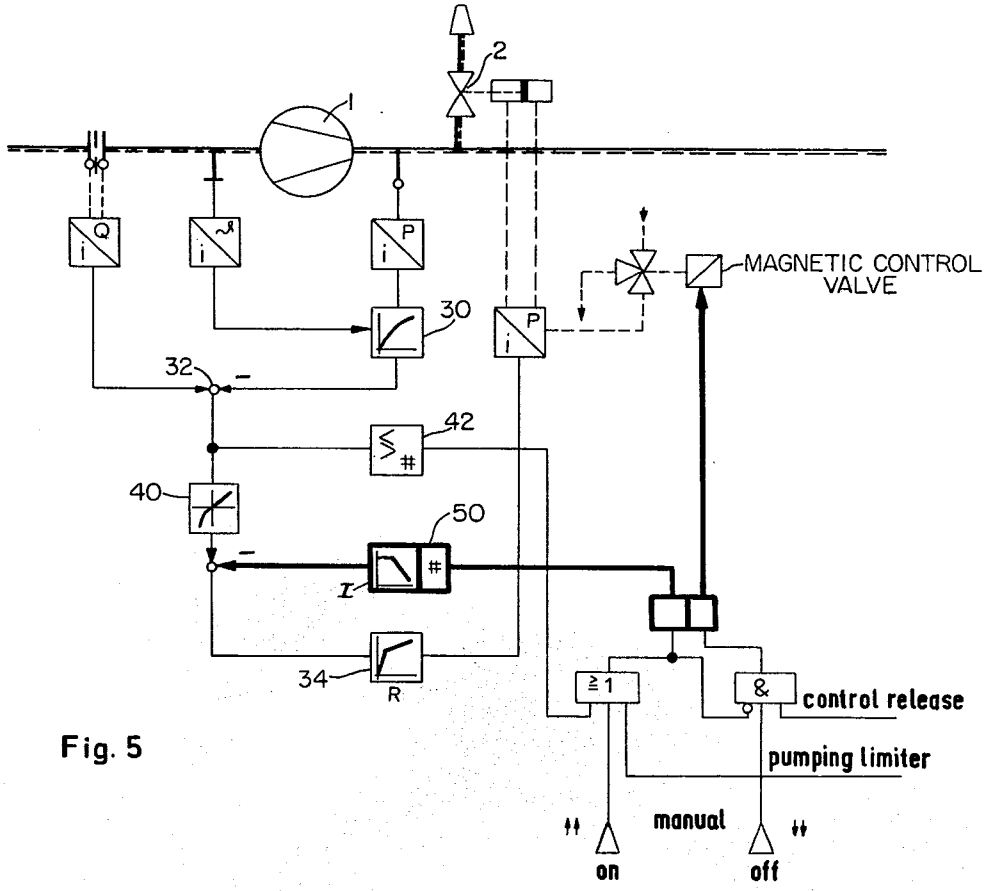
FIG. 5 shows the diagram of FIG. 4 in combination with a start-up circuit.

To this end, as shown in FIG. 5, a start-up circuit including a controllable integrator 50 is employed, which circuit operates as follows:

During start-up of the compressor, the blow-off valves are open under control. For the duration of this control command, integrator 50 is set to a variable factor of such magnitude that the sum of this factor and of the control difference positively provides for the production of an opening command of the controller. The output voltage of integrator 50 is opposite in polarity to a permissible control difference. In this way, a non-permissible control difference is simulated for the controller, and the latter responds correspondingly. When the start-up operation of the compressor is completed, slow closing of the blow-off valves may be allowed to take place until the operating point of the compressor reaches the blowing-off line or curve. The integrator I is released (cleared),, and the contents thereof is discharged at an adjustable rate of speed, while its output signal accordingly goes from the initial value to the value of zero. In this way, the true control difference increasingly takes effect in the pumping limit controller such that the latter slowly closes the blow-off valves to such degree that the operating point of the compressor is caused to reach the blowing-off curve. By suitable selection of the rate of discharge of integrator 50 it is ensured that the operating point of the compressor does not exceed the blowing-off curve during the start-up operation.

In prior control systems, it is known to process manual control commands in the form of a continuous electrical signal and the output signal of the pumping limit controller within an extreme value selection circuit the output signal of which serves to control or drive regulating drive means adjusting the blow-off valves. In this way, it is ensured that the blow-off valves may be further opened manually, but not closed to any further degree than dictated by the pumping limit controller. However, this system suffers from the drawback that an extremely rapid variation of the manual control signal from "opening" towards "closing" may result in overshooting conditions similar to those occuring in start-up processes without the above explained start-up circuit.

Figure 6:
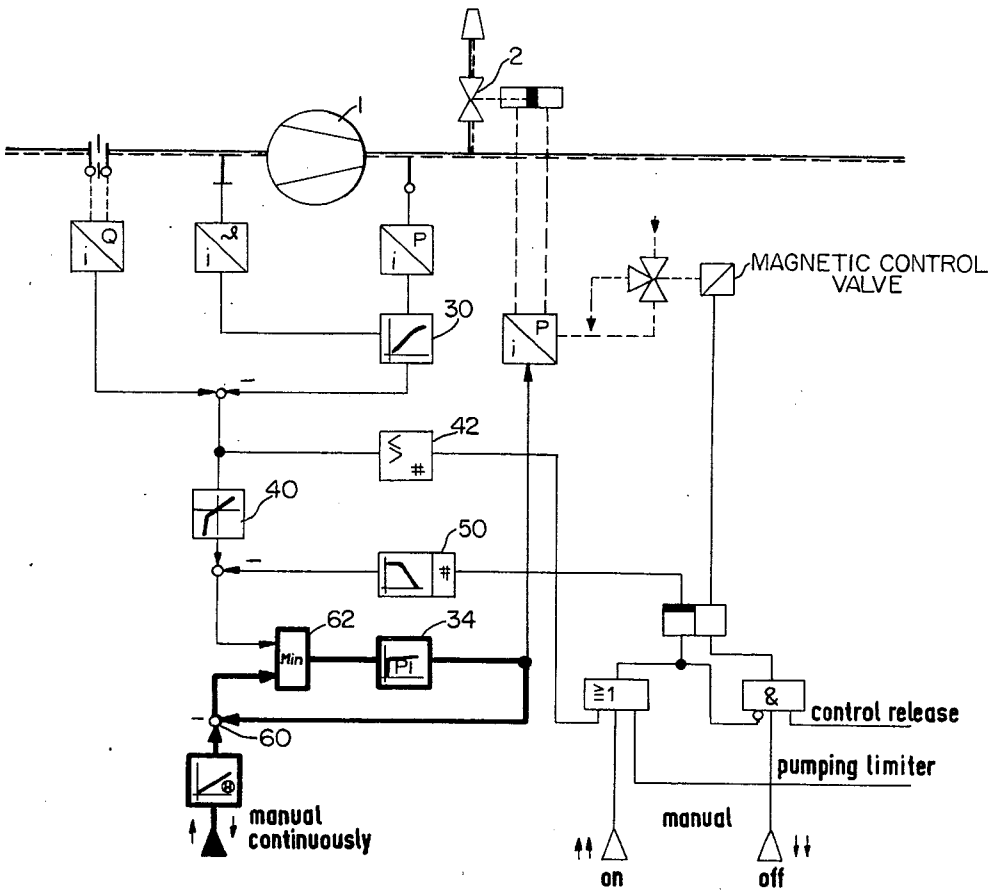
FIG. 6 shows the diagram of FIG. 5 incorporating an extreme value selection.

In order to avoid this phenomenon, the manual control signal is compared with the output signal of the pumping limit controller in comparator 60 as shown in FIG. 6. This difference and the control difference of the pumping limit controller are fed to circuit 62 for the minimum value selection. The output signal of such circuit is applied to pumping limit controller 34 in the place of the control difference. In this way, it is ensured that the blow-off valves, although adapted to be opened manually to still further degree, cannot be closed any further if this would result in the compressor operating point exceeding the blowing-off curve. However, as the ourput signal of pumping limit controller 34 always corresponds to the actual position of the blow-off valves, the abovementioned overshooting condition cannot result.

What we claim is:

1. A method of operating turbo compressors, particularly large blast furnace compressors, wherein (rate of) flow and discharge pressure are measured continuously, and wherein, in order to prevent pumping surges from occuring, i.e. prior to reaching the pumping limit, it is ensured by the opening of blow-off valves upon reaching a blowing-off line or curve extending in parallel to said pumping limit, that the compressor flow is prevented from falling below a minimum value depending on the discharge pressure, characterized by non-linearly amplifying the control difference of the pumping limit controller for adjusting the blow-off valves and being dependent on the actual values of pressure and flow, in such a manner that the amplification (factor) or gain is increased if the control difference goes to the negative, i.e. if the operating point of the compressor shifts into the non-permissible range beyond the blowing-off line or curve.

2. The method according to claim 1, characterized by increasing the amplification (factor) or gain as soon as the operating point of the compressor exceeds the blowing-off curve by a predetermined small amount.

3. The method according to claim 1, characterized in that the characteristic curve of the non-linear transmission element (NL) is composed of at least two straight lines of increasing clope.

4. The method according to claim 1, characterized by additionally supplying to the pumping limit controller a controlled, timedependent or timed signal for start-up of the compressor, with the polarity of said signal being opposite to a permissible control difference.

5. The method according to claim 1, characterized by fully opening said blow-off valves independent by of the remainder of the control (system) when the compressor operating point reaches a cut-off line or curve (FIG. 2) falling between the pumping limit and the blowing-off line or curve.

6. The method according to claim 1, characterized by performing manual control of said blow-off valves by means of an extreme value selection to which the control difference and the difference of the manual control signal and the output signal of said controller are superimposed with equal status and which provides an output signal corresponding to the respective lowest value of the input signals.

* * * * *